US007077309B2

(12) United States Patent
Andrews, Sr.

(10) Patent No.: US 7,077,309 B2
(45) Date of Patent: Jul. 18, 2006

(54) BEVERAGE CONTAINER

(75) Inventor: Jared P. Andrews, Sr., Redlands, CA (US)

(73) Assignee: J & M Coffee Container Company, Inc., San Bernardino, CA (US)

( * ) Notice: Subject to any disclaimer, the term of this patent is extended or adjusted under 35 U.S.C. 154(b) by 429 days.

(21) Appl. No.: 10/626,176

(22) Filed: Jul. 24, 2003

(65) Prior Publication Data

US 2005/0017011 A1 Jan. 27, 2005

(51) Int. Cl.
*B65D 5/74* (2006.01)

(52) U.S. Cl. ..... 229/117.15; 229/117.14; 229/117.3; 229/117.35

(58) Field of Classification Search ..... 229/117.3, 229/117.32, 117.35, 117.14, 117.15; 383/35; 222/105

See application file for complete search history.

(56) References Cited

U.S. PATENT DOCUMENTS

| | | | | |
|---|---|---|---|---|
| 181,014 | A | 8/1876 | Scott | |
| 1,129,778 | A * | 2/1915 | Baldwin | 383/35 |
| 1,984,611 | A * | 12/1934 | Weaver | 229/117.14 |
| 2,413,721 | A | 1/1947 | Lobl | |
| 2,574,931 | A | 11/1951 | Nason | |
| 2,618,409 | A | 11/1952 | Eisenberger et al. | |
| 2,714,982 | A | 8/1955 | Strauss | |
| 2,946,494 | A | 7/1960 | Kuss | |
| 2,954,901 | A | 10/1960 | Winstead | |
| 2,990,101 | A | 6/1961 | Mead et al. | |
| 3,054,549 | A | 9/1962 | Humphrey | |
| 3,090,526 | A | 5/1963 | Hamilton et al. | |
| 3,119,543 | A * | 1/1964 | Walker | 229/117.3 |
| 3,126,140 | A * | 3/1964 | Lizan et al. | 229/117.15 |
| 3,140,811 | A | 7/1964 | Hall et al. | |
| 3,143,249 | A | 8/1964 | Merrill et al. | |
| 3,160,326 | A | 12/1964 | Sturdevant et al. | |
| 3,163,544 | A | 12/1964 | Valyi | |

(Continued)

FOREIGN PATENT DOCUMENTS

| | | |
|---|---|---|
| EP | 273 102 | 7/1987 |

(Continued)

*Primary Examiner*—Gary E. Elkins
(74) *Attorney, Agent, or Firm*—Knobbe, Martens, Olson & Bear, LLP

(57) ABSTRACT

An improved beverage container comprising a flexible bag capable of containing liquids disposed in a collapsible box is described. The box comprises a right side wall with a lower flap configured to form a portion of the box bottom and an upper flap configured to form a portion of a handle. The box also comprises a left side wall with a lower flap configured to form a portion of the box bottom and an upper flap configured to form a portion of a handle. The box further comprises a rear wall with a lower flap configured to form a portion of the box bottom and an upper flap having a portion configured to surround the handle, the upper flap further comprises a distal portion configured to surround a mouth attached to the flexible bag. The box also comprises a front wall with an opening for receiving a mouth of the flexible bag, the front wall also has a lower flap configured to form a portion of the box bottom. The flexible bag is mounted inside the box by inserting the mouth through the openings formed in the front wall and upper flap distal portion. The flexible bag comprises a tab disposed on a rear sheet opposite the mouth such that the tab may be pulled to introduce air into the bag.

12 Claims, 9 Drawing Sheets

U.S. PATENT DOCUMENTS 3,169,690 A 2/1965 Scholle
3,173,579 A 3/1965 Curie et al.
3,186,625 A * 6/1965 Mcad et al. ..... 383/35
3,227,322 A 1/1966 Crain
3,233,817 A 2/1966 Casady
3,349,986 A 10/1967 Chapman
3,363,807 A 1/1968 Powell
3,416,719 A 12/1968 Pilger
3,484,011 A 12/1969 Kenneth et al.
3,927,824 A 12/1975 Razziano
3,931,916 A 1/1976 Blue et al.
4,209,092 A 6/1980 Jones
4,308,995 A 1/1982 Hanes
4,375,864 A 3/1983 Savage
4,653,671 A 3/1987 Duffy et al.
4,771,917 A 9/1988 Heaps, Jr. et al.
4,781,314 A 11/1988 Schoonover et al.
4,815,631 A 3/1989 Eeg et al.
5,048,691 A * 9/1991 Heuberger et al. ..... 229/117.3
5,050,775 A * 9/1991 Marquardt ..... 229/117.3
5,054,644 A 10/1991 Greenslade
5,106,015 A 4/1992 Vlasaty et al.
5,125,566 A 6/1992 Deiger
5,147,062 A 9/1992 Heuberger et al.
5,147,071 A 9/1992 Rutter et al.
5,156,295 A * 10/1992 Gordon et al. ..... 229/117.35
5,163,485 A 11/1992 Hermann
5,169,019 A 12/1992 Bedenbender
5,392,958 A 2/1995 Kurtzahn et al.
5,562,228 A 10/1996 Ericson
5,715,992 A * 2/1998 Andrews et al. ..... 229/117.3
5,769,273 A * 6/1998 Sasaki et al. ..... 222/105
5,829,637 A * 11/1998 Takemura et al. ..... 222/105
5,897,050 A 4/1999 Barnes
5,909,841 A 6/1999 Andrews, Sr. et al.
6,053,401 A 4/2000 Andrews, Sr.
6,062,431 A 5/2000 Geshay
6,105,821 A 8/2000 Christine et al.
6,139,187 A 10/2000 Galomb et al.
6,164,526 A 12/2000 Dalvey
6,196,452 B1 3/2001 Andrews, Sr. et al.
6,253,993 B1 7/2001 Lloyd et al.
6,290,124 B1 9/2001 Andrews, Sr. et al.
2003/0024950 A1 * 2/2003 Yoneyama et al. ..... 222/105

FOREIGN PATENT DOCUMENTS

GB 1529062 10/1978
WO WO 93/11050 A1 6/1993
WO WO-93/11050 A1 * 6/1993 ..... 383/35

* cited by examiner

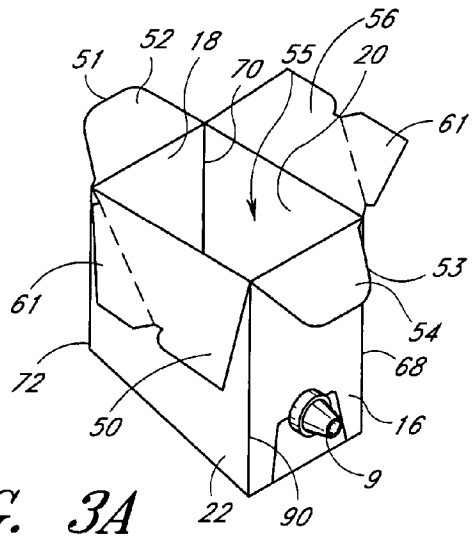
FIG. 3A
(PRIOR ART)
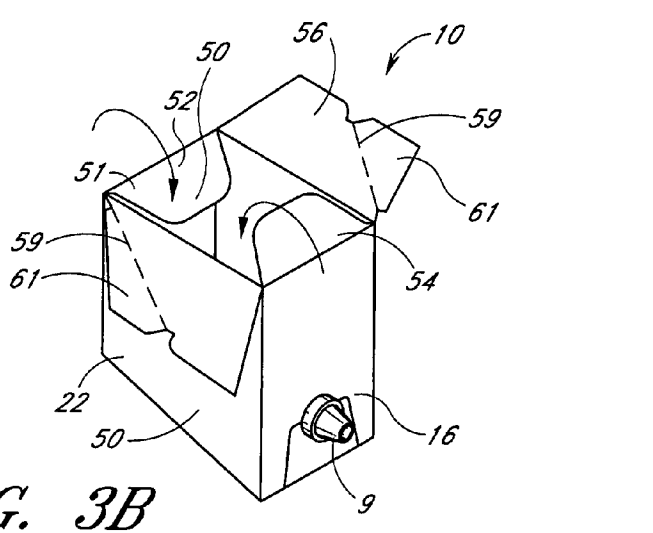
FIG. 3B
(PRIOR ART)
FIG. 3C
(PRIOR ART)
FIG. 3D
(PRIOR ART)

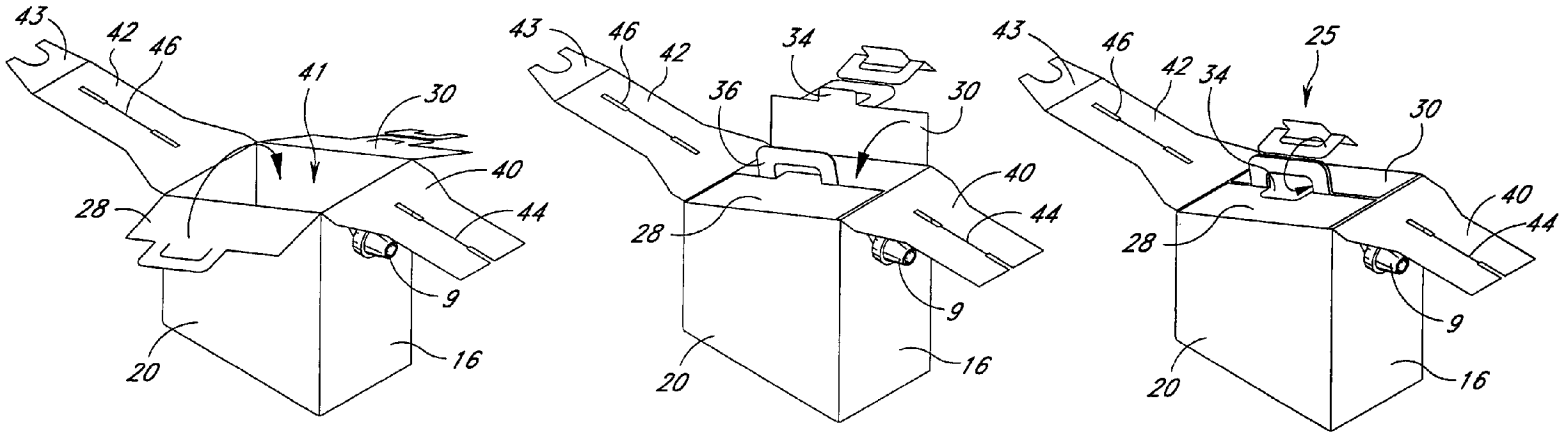
FIG. 4A
(PRIOR ART)
FIG. 4B
(PRIOR ART)
FIG. 4C
(PRIOR ART)
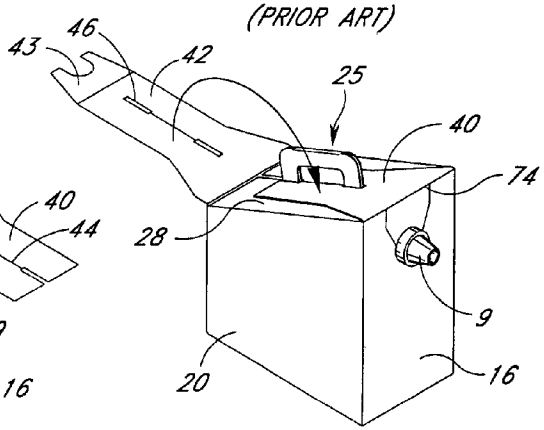
FIG. 4D
(PRIOR ART)
FIG. 4E
(PRIOR ART)
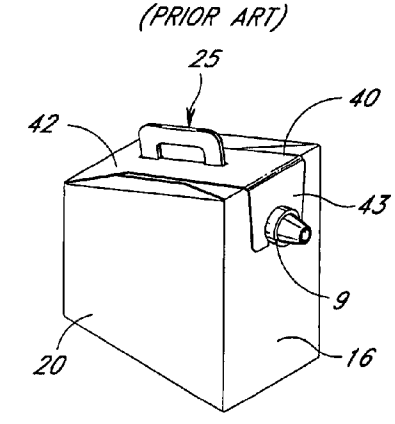
FIG. 4F
(PRIOR ART)

BEVERAGE CONTAINER

RELATED CASES

This application claims priority to U.S. patent application having Ser. No. 10/205,586, filed on Jul. 24, 2002, which application was subsequently converted to U.S. Provisional Patent Application having Ser. No. 60/453,731, the entire contents of which is expressly incorporated herein by reference.

BACKGROUND

1. Field of the Invention

This invention relates to an improved beverage container. More specifically, this invention is directed to an improved container for storing, transporting, and dispensing several cups of fluid, such as coffee.

2. Description of the Related Art

Gourmet coffee shops typically sell individual cups of coffee for consumption on or off the premises. Typically, these shops are very small and utilize high-quality coffee beans and coffee-making equipment to provide consumers with a higher quality beverage than would be available in other establishments. In this regard, many gourmet coffee shops have developed internal procedures particularly adapted to ensure a uniformly high-quality product. Particularly at peak periods, these shops must dispense coffee, and other beverages, to a relatively large group of consumers in a short amount of time. Typically, the worker holds a single-serving cup below the spout and utilizes the other hand to actuate the spout until the worker sees that the coffee cup is nearly full.

Particularly among coffee drinkers, those accustomed to the high-quality coffee available from such gourmet coffee shops have come to desire this high level of quality at other locations, such as offices or meeting places. Gourmet coffee shops have met this need by loaning insulated canisters to the consumer. These canisters are often tall, cylindrical canisters having a pump button in the top, which dispenses coffee from a nozzle. Unfortunately, the inconvenience of needing to return the canister and the typical requirement that a deposit be left deters consumers from purchasing larger quantities of coffee. These canisters also have several drawbacks for the coffee shop, such as they are relatively large and difficult to store, are breakable and require careful cleaning after each use.

One potential solution is represented in a container shown and described in U.S. Pat. No. 5,715,992 (the "'992 patent"). The container taught by the '992 patent includes a collapsible box with a flexible bag contained therein. Notwithstanding the particular advantages of the container taught in the '992 patent, there remains a need for an improved disposable beverage container.

SUMMARY

An improved beverage container is provided wherein, according to one aspect of the improved beverage container disclosed herein, a beverage container has an outer shell having a first, second, third and fourth sidewall. The first sidewall has an opening formed therein plus a lower flap extending downwardly. The second sidewall has an upper flap defining a portion of a handle, and a lower flap. The third sidewall has an upper flap having a slot for receiving the handle and a second opening. The third sidewall additionally has a lower flap. The fourth sidewall has an upper flap having a portion of a handle, and has a lower flap. The upper flaps fold and cooperate to form a top surface of the outer shell, while the lower flaps fold and cooperate to form a bottom surface of the outer shell. The openings in the first and third sidewalls cooperate to receive and support the mouth of a flexible interior liner that holds a liquid beverage.

The lower flaps comprising the bottom surface may provide a bottom surface having multiple layers of material, thereby further inhibiting the heat transfer. The upper flaps fold together and cooperate to define an upper surface and a handle extending from the upper surface.

The beverage container may include a fluid reservoir having a bag portion and a mouth portion. The mouth portion is configured to be inserted through the openings in the sidewalls and to be supported thereby. The mouth may optionally have a retaining portion, such as a groove, for engaging the periphery of the openings thereby helping to maintain the mounted position of the mouth relative to the outer shell.

The beverage container may allow more than one handle portion to cooperate to create a secure handle that extends perpendicularly from the top surface. The top surface may be oriented at an angle with respect to the bottom surface such that when the container is tipped so that the handle is substantially horizontal, the contents inside the container flow through the mouth and are dispensed.

According to yet another aspect of the improved beverage container, a method for erecting a beverage container is provided. The beverage container preferably has a front wall, a back wall, one or more side walls, a bottom surface, and a top surface. A plurality of lower flaps are folded to create the bottom surface. A flexible liner is placed inside the container and a mouth of the liner is inserted an opening formed the front wall. Two of the top flaps are folded and cooperate to create a handle. A flap extending from the back wall folds over the handle and has a slot for receiving the same and further has an opening configured to receive the mouth of the liner and provide additional support thereto.

According to yet another aspect, a foldable liquid container includes an outer shell having sidewalls that are generally perpendicular to one another and an opening formed in one of the sidewalls. There are a plurality of upper flaps depending from the sidewalls that cooperate to form a handle and an upper surface of the container. A bag is provided that fits inside the outer shell and includes a spout that fits within the opening formed in the sidewall. The opening in the sidewall may further have radial slits radiating therefrom to facilitate inserting the spout through the sidewall opening. The spout may also fit within an opening formed in one of the upper flaps and is further supported thereby. The opening formed in one of the upper flaps may optionally have radial slits emanating therefrom to facilitate inserting the spout through the opening. Preferably, the handle is strong enough to support the weight of the filled container in both a filling position and in a transporting position. The bag additionally has a tab that, when pulled, expands the bag and allows air to enter.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention, certain preferred embodiments and modifications thereof will become apparent to those skilled in the art from the detailed description having reference to the figures that follow, of which:

FIGS. 3*a–d* are perspective views illustrating the formation of the bottom of the beverage container of FIG. 1;

FIGS. 4*a–f* are perspective views illustrating the formation of the top of the beverage container of FIG. 1;

DETAILED DESCRIPTION

Figure 1:
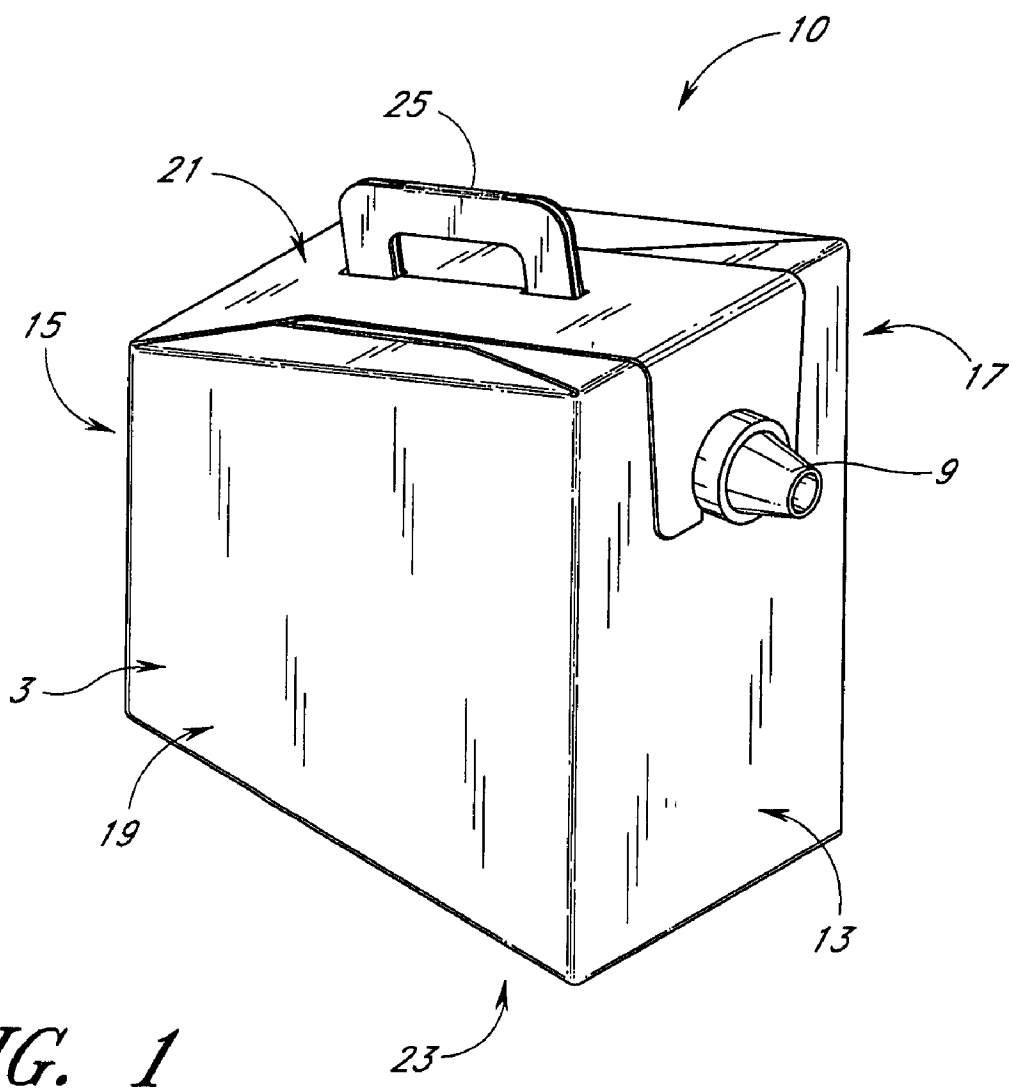
FIG. 1 (PRIOR ART)
FIG. 1 is a perspective view of a beverage container of the prior art.

To better appreciate the advantages of the preferred container, a prior art beverage container will now be described. FIGS. 1–7 illustrates a beverage container constructed in accordance with the teachings of the prior art. Referring to FIGS. 1–6, the beverage container 10 includes an outer container or shell 3, and an inner bag 5 having a mouth 7 and a spout 9. The bag 5 is positioned within the outer shell 3 and communicates with the exterior of the container 10 through the mouth 7 and spout 9. The container 10 has a front 13, a back 15, a left side 17, a right side 19, a top 21 and a bottom 23. In addition, the container advantageously defines a handle 25.

Figure 2:
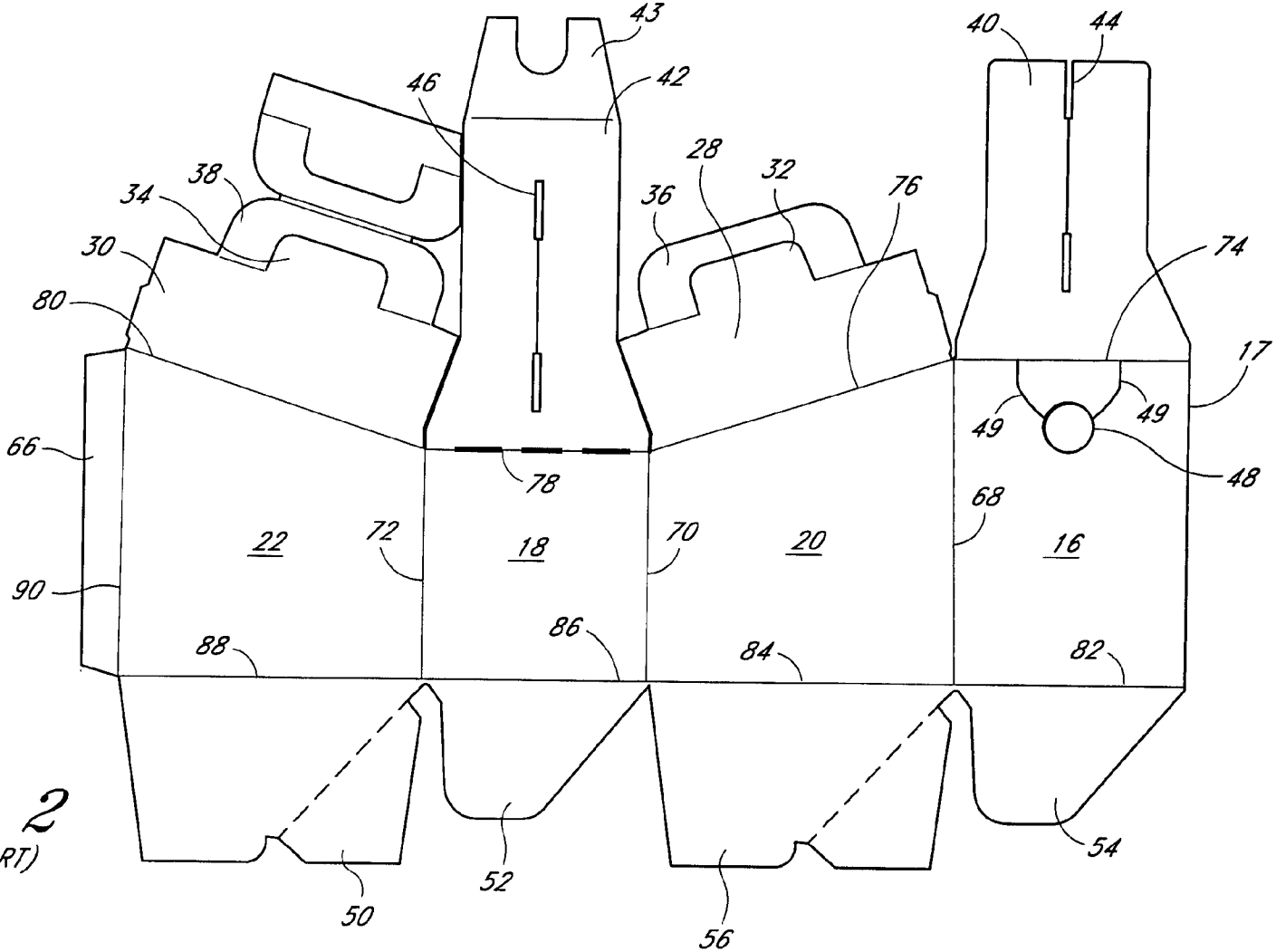
FIG. 2 (PRIOR ART)
FIG. 2 is a top plan view of a blank from which the outer shell of the container of FIG. 1 is manufactured.

As seen in FIG. 2, the outer shell 3 is advantageously configured to be constructed from a one-piece cardboard blank. Of course, the outer shell 3 could be constructed of other materials, such as, for example, fluted or corrugated plastics such as COROPLAST™, other non-corrugated plastics, or other foldable materials. The shell has a front wall panel 16, a back wall panel 18, a right side wall panel 20, a left side wall panel 22 and a side attachment tab 66. The front wall panel 16 defines a circular opening 48 and tapered slits 49. The front wall panel 16 is hingedly attached, such as by folding, along a right front fold line 68 to right side wall panel 20. Adjacent the right front fold line 68, the right side wall panel 20 is hingedly attached to the back wall panel 18 along a right back fold line 70. Opposite the right back fold line 70, the back wall panel 18 is hingedly attached to the left side wall panel 22 along a left back fold line 72. Adjacent the left back fold line 72, the attachment tab 66 is attached to the left wall panel 22 along a left front fold line 90, such as by an adhesive.

The blank further incorporates a series of top flaps and a series of bottom flaps. The top flaps include a top front flap 40, a top right handle flap 28, a top back flap 42 and a top left handle flap 30. The bottom flaps include a front bottom flap 54, right bottom flap 56, a back bottom flap 52 and a left bottom flap 50. The top front flap 40 is hingedly secured along a top front fold line 74 to the front wall panel 16. Likewise, the bottom front flap 54 is hingedly secured along a bottom front fold line 82 to the front wall panel 16. A circular 48 is formed within the front wall panel 16 in close proximity to the top front fold line 74. The top front flap 40 defines an open-ended slot 44 extending to a distal edge of top front flap 40.

The right side panel 20 is hingedly coupled along a top right fold line 76 to top right handle flap 28 and is also hingedly secured along a bottom right fold line 84 to a bottom right flap 56. The top right handle flap 28 includes a right handle portion 36 and a right tab portion 32. The bottom right flap 56 defines a small, generally semi-circular slit 62 which forms a finger flap 63.

Similar to the construction of the front wall panel 16, the back wall panel 18 hingedly carries a top back flap 42 and a bottom back flap 52 by respective fold lines 78, 86. The top back flap 42 includes a closed slot 46 and a generally U-shaped distal locking portion 43. A top left handle flap 30 extends from the left side wall panel 22 at top left fold line 80, while a bottom left flap 50 extends from the left side wall panel 22 from at bottom left fold line 88.

The top left handle flap 30 includes a double left handle portion 38 and a pair of left tab portions 34, 39 which are formed by cutouts to define an opening underneath the left handle portion 38. The bottom left flap 50 defines a small, generally semi-circular slit 75 which forms a finger flap 77.

The bag 5 may be connected to the outer shell 3. As will be appreciated by those of skill in the art from the description and figures, the bag may be adhered to one or more of the sidewalls of the outer shell. In one preferred embodiment, the bag 5 comprises several layers, having an inside taste-neutral layer that imparts no flavor, a middle layer that insulates the liquid, and an outer layer for providing strength and flexibility. Such bags are available from Scholle Corporation, having a manufacturing facility in Rancho Dominguez, Calif. According to another preferred embodiment, the bag may be formed from one or more layers of material exhibiting the desired characteristics. In one preferred embodiment, the bag is constructed from two flat sheets that overlay one another and are then heat sealed together to form the sealed edges of the bag and then cut to form the desired shape. The spout may optionally be attached through heat welding during the same bag forming step. The mouth 7 has a generally cylindrical body 92 (FIG. 9*a*) with an annular outer rim 94 at one end which is bonded to the bag 5 as described above, or may be bonded by an appropriate adhesive or other means known in the art, and external threads 96 at the other end. The body 92 is desirably provided with a raised annular ring spaced slightly from the outer rim 94 which effectively forms an annular groove between raised annular ring and the outer rim 94. The body 92 of the mouth 7 further defines a generally cylindrical internal channel 100. The mouth 7 is advantageously sized and shaped for the external threads 96 and raised annular ring to be slightly larger than the opening 48 in the front wall panel 16 of the outer shell 3.

Figure 6:
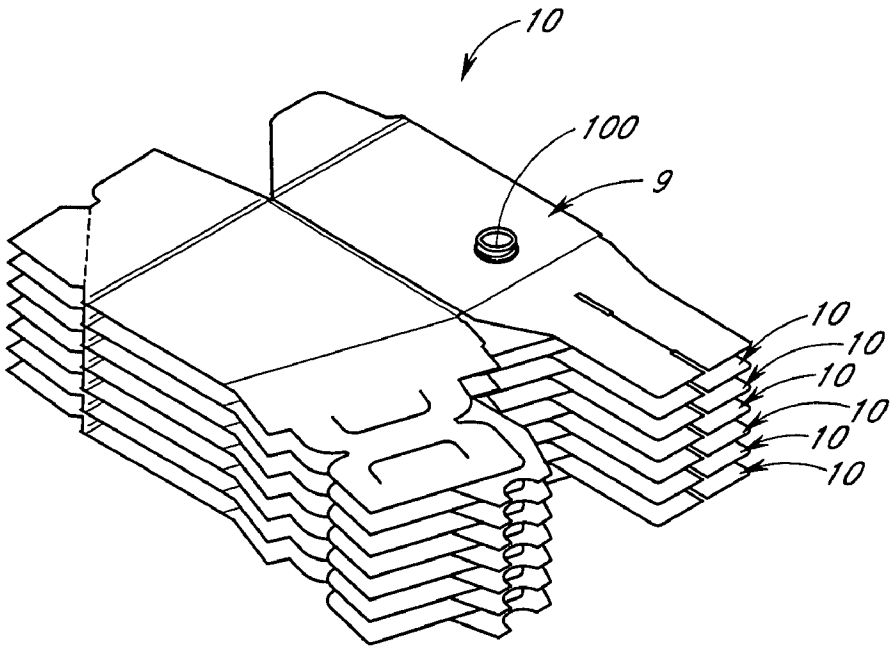
FIG. 6 (PRIOR ART)
FIG. 6 is a perspective view of several beverage containers of FIG. 1 stacked in collapsed form.
Figure 8:
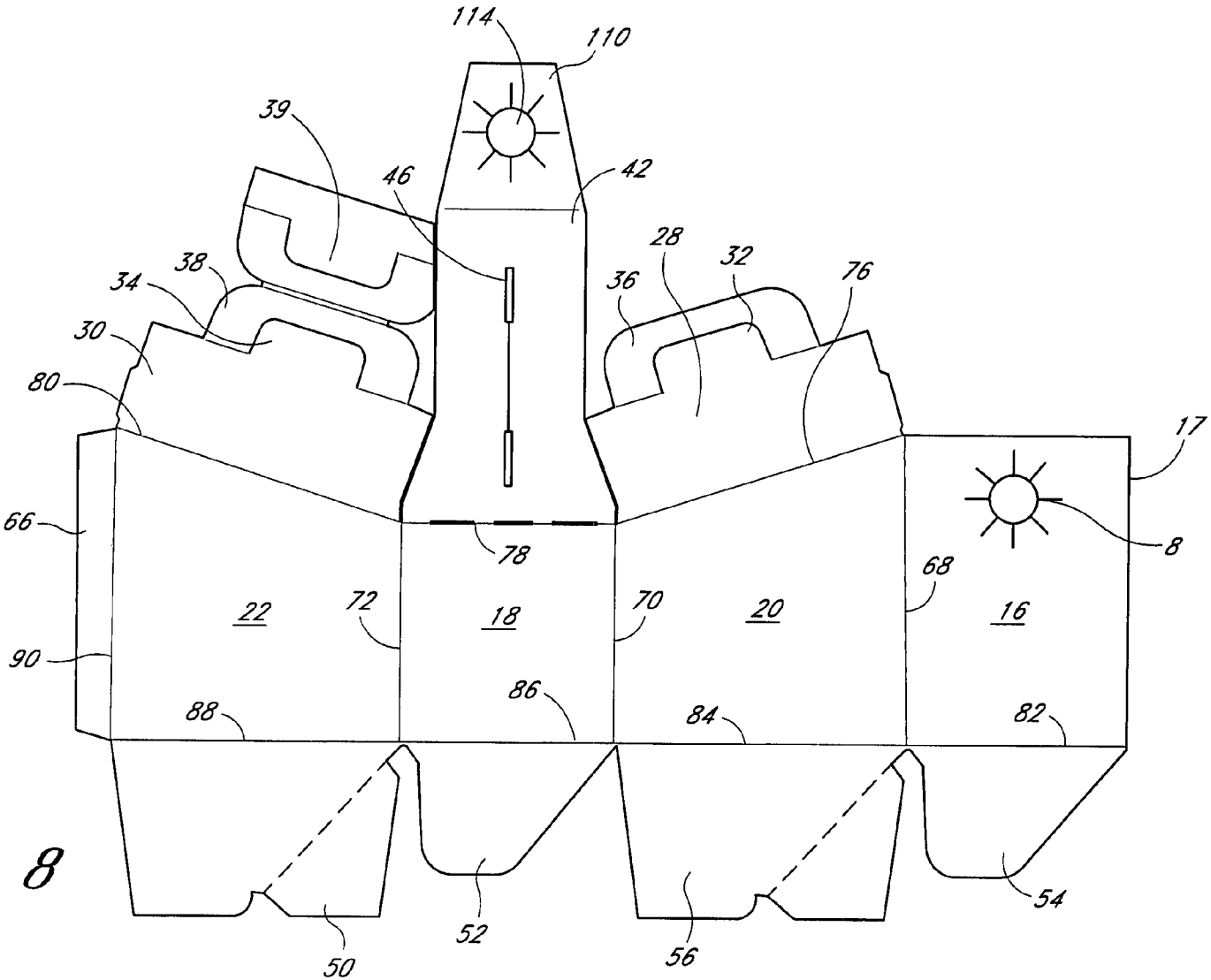
FIG. 8 is a top plan view of a blank from which an outer shell of an improved beverage container is manufactured.

Preferably during manufacture and before shipping to an end user, the tab 66 of the left side wall panel 22 is fastened to the front wall panel 16 along an edge 17 of the front wall 16 opposite of the right front fold line 68. The fastening may be accomplished by double sided tape, adhesive, or other fastening means known to those of skill in the art. Upon fastening, the outer shell 3 may then be laid and stored flattened with two adjacent panels, such as panels 16 and 20 for example, facing upwards, and the other two side wall panels, panels 18 and 22, facing downwards. The outer shell is thus ready for quick assembly and may be stored efficiently in stacks as illustrated in FIG. 6. Advantageously, the spout 9 is threaded onto the mouth after the container has been filled.

Figure 5B:
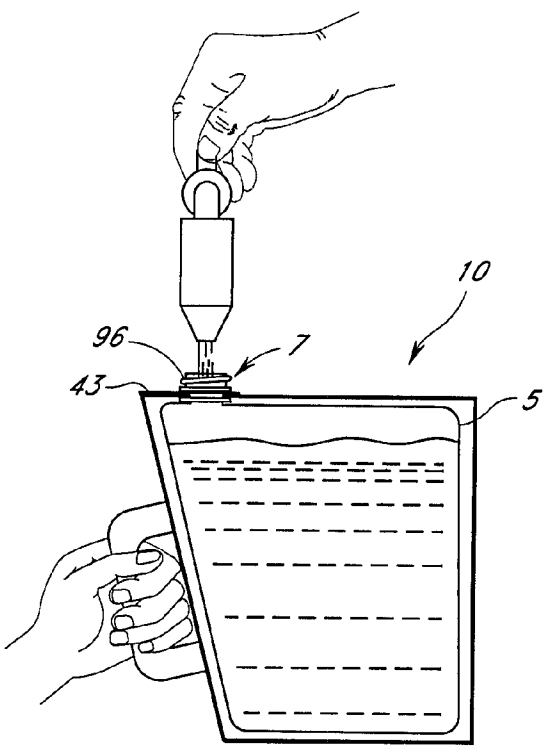
FIG. 5B (PRIOR ART)
FIGS. 5*a–b* are cross-sectional front views illustrating the filling of the bag of the beverage container of FIG. 1.
Figure 5A:
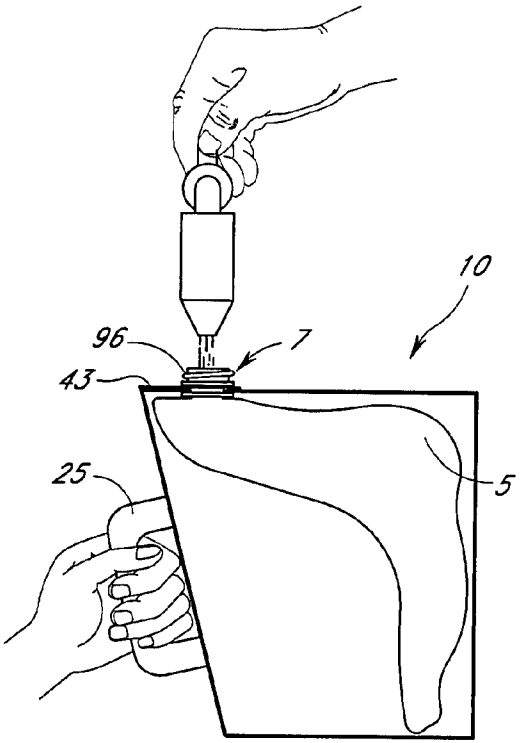
FIG. 5A (PRIOR ART)
Figure 5C:
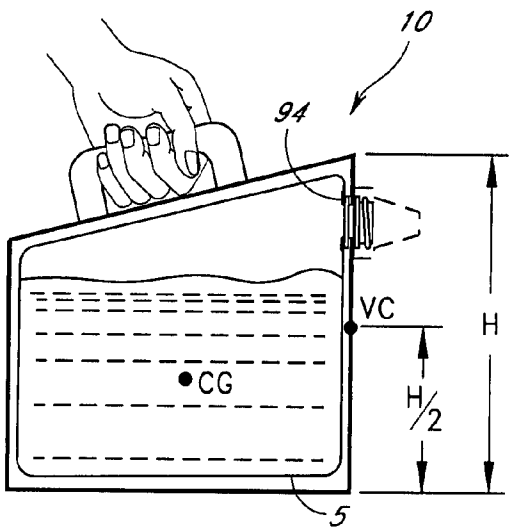
FIG. 5C (PRIOR ART)
FIG. 5*c* is a cross-sectional side view illustrating the container of FIG. 1 rotated 90° clockwise with respect to FIGS. 5*a–b*.
Figure 7:
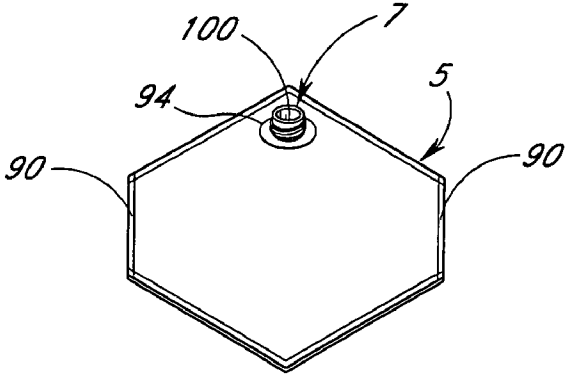
FIG. 7 (PRIOR ART)
FIG. 7 is a perspective view of the flexible bag and mouth of the container of FIG. 1.

Referring to FIGS. 4 and 5, the spout 9 of the container will now be described. The spout is desirably conical in shape and is internally threaded to mate with the external threads 96 of the mouth 7. For convenience, the mouth may include a tear-off portion for sealing the container, until the destination is reached. In an alternative embodiment, the spout may be omitted, and a cap may be provided to close the mouth as illustrated in FIGS. 9*b*–9*f*, thus reducing cost.

The assembly of the container 10 will now be described. FIGS. 3*a*–*d* illustrate the assembly of the bottom of the outer shell 3. FIG. 3*a* shows the container 10 turned over so that the bottom flaps 50, 52, 54, and 56 are facing upwards and the wall panels 16, 18, 20, and 22, folded to form a substantially rectangular opening 55. In this position, the front wall panel 16 is folded along left front fold line 90 so that the front wall panel is perpendicular to the left side wall panel 22. The front wall panel 16 is also oriented perpendicularly with respect to right side wall panel 20 along right front fold line 68, so that left side wall panel 22 and right side wall panel 20 are parallel to each other. The back wall panel 18 is folded along the left back fold line 72 to be perpendicular to the left side wall panel 22, and is also folded along the right back fold line 70 to be perpendicular to the right side wall panel 20. The back wall panel 18 is thus parallel to the front wall panel 16. Preferably, the outer shell 3 is shipped in a flattened configuration with the side attachment tab 66 already affixed to the front wall 16. Of course, the side attachment tab 66 could be disposed between any two of the panels 16, 18, 20, 22. As a first assembly step, a user simply applies a slight force to the outer edges of the folded outer shell 3, which causes the panels to pivot about their respective fold lines. Initially, the outer shell 3 resembles a parallelogram, but as the outer shell 3 is further manipulated, the panel walls form 90 degree angles with respect to adjacent walls and the outer shell 3 then resembles a rectangle or square as shown in FIG. 3*a*.

As illustrated in FIG. 3*b*, the bottom front flap 54 and bottom back flap 52 are folded inwardly such that the flaps 54, 52 are perpendicular their respective wall panels 16, 18. As shown in FIG. 3*c*, the sidewall flaps 50, 56 are then folded inwardly. These sidewall flaps 50, 56 each have a fold line 59 thereby defining an adhering portion 61. The adhering portion is configured to adhere to the respective bottom front flap 54 and bottom back flap 52. This may be accomplished by placing an adhesive either on the adhering portion 61, or on the respective flap 54, 52. The adhesive may be any type of suitable adhesive such as moisture activated glue, or covered with a protective plastic sheet, or other type of adhesive such that the adhesive can be selectively activated to engage the adhering portions 61 with the flaps 52, 54. As such, a user activates the adhesive and folds the bottom flaps 50, 56 and tucks the adhering portions 61 under the opposing bottom flap 50, 56, such that the adhering portions 61 directly contact the underlying bottom front flap 54 and bottom back flap 52. The result is an outer shell having a secure bottom that maintains the outer shell in an erected configuration. This assembly is fast and simple and thereby increases employee efficiency and decreases the potential for error. Moreover, the bottom of the outer shell now comprises a plurality of layers, thereby offering a more effective layer of insulation to a table or other supporting surface the container may be placed upon.

FIGS. 4*a*–4*f* illustrate the formation of the top and handle 25 of the outer shell 3. FIGS. 4*a* and 4*b* indicate that the top right handle flap 28, which is secured to right side wall panel 20 along top right fold line 76, is folded over into the upper opening 41 so that the top right handle flap 28 is generally perpendicular to the right side wall 20. FIG. 4*b* illustrates that right handle portion 36 is then folded upward from the top right handle flap 28 so that the right handle portion 36 is perpendicular to the top right handle flap 28.

FIG. 4*c* shows that the top left handle flap 30 is then folded down and the left handle portion 38, which is also folded upright like the right handle portion 36, cooperates with right handle portion 36. The left handle portion tab 34, which is cutout from underneath the left handle portion 38 is placed through the opening underneath the right handle portion 36 and over the right tab 32. As shown in FIG. 4*d*, the left handle portion 38 is then folded over the right handle portion 36 and the distal tab 39 of the left handle portion 38 is slid under the proximal tab 34 of the left handle portion to form the handle 25 of the outer shell 3. FIG. 4*e* shows top front flap 40 folded over along top front fold line 74 onto the top right handle flap 28 and the top left handle flap 30. The handle 25 is inserted through the open-ended slot 44, thereby allowing the top front flap 40 to rest flat against the right and left handle flaps 28 and 30. As shown in FIG. 4*f*, the top back flap 42 is folded over along top back fold line 78 onto the top front flap 40 and the top right and left handle flaps 28 and 30. The handle 25 is inserted through the slot 46 of the top back flap 42, allowing the top back flap 42 to rest flat against the top front flap 40 and the top right and left handle flaps 28 and 30. The distal locking portion 43 of the top back flap 42 is inserted into the groove formed by the body 92 of the mouth 7 so that the locking portion prevents the mouth from being pulled back into the outer shell 3 by the weight of the liquid when filled. The top front flap 40 and the top back flap 42 lock the handle flaps 28, 30 in place. Thus assembled, the handle 25 extends away from the outer shell 3 and defines an opening sized and shaped to receive the fingers of a hand.

In one embodiment, the front 13 of the outer shell 3 has a vertical height of roughly 8½ inches and a width of roughly 6⅛ inches. The bottom 23 has a width of roughly 6⅛ inches and a length of roughly 8½ inches. The back 15 of the outer shell has a height of roughly 6 inches and a width of roughly 6¼ inches. Of course, other dimensions are possible.

FIGS. 5*a* and 5*b* illustrate the filling of the container 10. FIG. 5*a* is a schematic view illustrating the compressed, flexible bag 5 located within the outer shell 3 and the container in the "fill" position—the container 10 resting on its back wall panel 18 with the front wall panel 16 and mouth facing upwards.

In order to fill the flexible bag 5 with fluid, oftentimes the vacuum within the bag 5 must be released by introducing air into the bag, thereby separating a front sheet to which the spout is attached from a rear sheet. This vacuum is usually created during manufacture of the bag 5. Typically, the bag comprises two layers of a material that lay on top of one another and are subsequently heat welded around their edges. The bag is then cut just outside the perimeter of the heat weld to form a fluid tight seal. Since the sheets of material lay substantially in direct contact with one another, there is no air present between the layers as the bag is subsequently welded and cut, thereby usually requiring an applied force to separate the sides and allow air into the finished bag. According to the embodiment shown in FIGS. 5*a* and 5*b*, the vacuum may be released by gripping the material of the bag which is opposite the spout, and pulling away from the spout towards the rear of the box. This is fairly difficult due to the fact that the vacuum typically causes the material of the bag to be drawn tightly to the spout, thus providing little or no material to grip. Moreover, the bag may be slippery, especially if an operator's fingers are wet. Alternatively, the vacuum may be broken by inserting a sterile object through the spout, and pushing the rear sheet away from the spout, however this requires the sterilization of the object to be inserted, thus creating an additional process step.

Once an initial quantity of air has been introduced into the bag 5, the user actuates a spigot or other dispensing mechanism of a source reservoir, such as a coffee pot. FIG. 5*b* illustrates coffee being poured into the bag 5 through the mouth 7 from a spigot spaced over the mouth 7, thereby forcing the bag to expand further. To maximize the volume of liquid that the beverage container 10 may hold, the bag 5 is sized and shaped so that it may expand to substantially fill the interior volume of the outer shell 3. Advantageously, the container has a capacity of between about 48 fluid ounces and 200 fluid ounces, and in some embodiments, between about 64 fluid ounces and 120 fluid ounces, and in one preferred embodiment, holds about 96 fluid ounces.

The mouth 7 defines a flow channel having a diameter of about ¾ inches, or 1 inch, or 1¼ inches. Consequently, the typical user is able to visually determine when the level of fluid in the bag is proximate the bottom of the mouth 7 and moves the spigot to cut off the flow of fluid into the container 10. The bag 5 is desirably sized such that when the level of fluid in the container is proximate the bottom of the mouth 7 when the container is positioned with its back wall panel 18 faced downward in a fill position, when the container 10 is rotated to rest on its bottom 23 with the handle 25 facing up, in a transporting position, the level of fluid in the bag 5 is preferably below the opening formed by the spout 9 or mouth 7. This reduces the risk of spilling during transport and the risk of injury to the user from spillage of hot coffee when the spout is opened. Typically, gravity causes the bag 5 to sag within the outer shell 3 when the container is rotated from its fill position to its transporting position so that the level of fluid is below the level of the mouth. The volume of fluid in the container when the level of fluid in the container is proximate the bottom of the mouth 7 in the container fill position, is referred to as the "normal fill volume."

In at least the illustrated embodiments of FIGS. 4 and 5, the top front flap 40 and top back flap 42 provide the advantage of minimizing the load on the handle 25 by transferring a portion of the container's weight from the handle 25 to the flaps 40 and 42. With the handle 25 secured in place, the container 10 may be easily transported and carried in its transporting position by the handle 25. The carrier thus avoids having to hold portions of the outer shell 3 which may be hot from the coffee or other liquid.

Another advantage of some embodiments of the container is that when the container is filled to its normal fill volume and positioned in a transporting position, the center of gravity CG of the filled container is located below the vertical center of the container VC (i.e., half-way between the top and bottom of the front panel 16 of the outer shell 3) and, in some embodiments, is located one or more inches below the VC of the container. This is important to reduce the risk that the container will tip over during transport. In addition, the cross-sectional area of the bottom of the outer shell 3 may be the same size as, or larger than, any horizontal cross-section of the container to further reduce the risk that the container will tip over when transporting or manipulating the container.

Advantageously, in at least one embodiment, the top of the outer shell 3 ramps upward from the back wall panel 18 to the front wall panel 16, which has the opening 48 for a spout. This design, among other things, increases user comfort while dispensing fluids from the container when a user grips the handle 25 and rotates the container 10 forward to pour the fluid within the container out of the spout 9. Specifically, as the user rotates the container such that the handle, and consequently, the top of the outer shell, is horizontal, the fluid begins dispensing.

Another convenient feature of some embodiments herein provides protection to a supporting surface, such as a table, when the container is filled with hot liquid and place thereon. Some embodiments of the present container provide multiple layers of outer shell 3 material in bottom flaps 50, 52, 54, and 56, thereby providing extra insulation from the heat.

The advantages so far described herein are all made possible in a low cost container 10 particularly adapted to be constructed of such low cost materials that it is economically feasible for the container to be disposable, thus eliminating the typical deposit requirement imposed by beverage vendors. This is a substantial advantage over the current beverage containers that required the consumer to leave a deposit and be required to return a dirty container to the vendor for careful cleaning. In addition to reducing cost to the vendor from purchasing insulated containers, the present container minimized storage space since the containers described herein may be stored flat and stacked upon one another until ready for use, there is no issue with breaking containers, vendor employees are not required to wash and sanitize reusable containers, and the cost of each container may be passed directly to the consumer.

The container 10 is also particularly adapted to be used to mix hot or cold flavored drinks by storing flavor crystals in the bag 5 of a flattened container until it is desired to add liquid thereto. In this case, the mouth 7 may be sealed by the spout 9 or other means, such as a removable foil cover to protect the bag contents from contamination or spilling.

Finally, the container 10 is also particularly adapted to be used to heat or cool liquids by placing a source of heat or a cold pack or ice in the outer shell 3 before closing either the top flaps or the bottom flaps of the outer shell. If ice is to be inserted into the outer shell, an additional water-proof liner may be inserted into the outer shell to preserve the integrity of the outer shell from melting ice. Alternatively, it is possible to insert ice through the mouth 7 into the bag 5, to chill fluid therein.

An embodiment of an improved collapsible beverage container is shown in FIGS. 8 and 9*a*–9*f*. As illustrated, a blank, such as a cardboard blank, comprises a front panel 16, a rear panel 18, a left side wall panel 22 and right side wall panel 20. This embodiment differs from those previously described by, among other things, omitting the top front flap. The elimination of a top front flap relative to the previous embodiments allows for simplified assembly by eliminating a process step. This also requires less material to be used, thereby resulting in a more lightweight, less expensive container.

The container additionally incorporates a distal locking portion 110 on a distal end of a top back flap 42. The distal locking portion 110 includes a substantially circular, or O-shaped, opening 114. The material surrounding the O-shaped opening 114 of the distal locking portion 110 may be provided with a plurality of radial slits 112 to allow the mouth 96 to be inserted therethrough. As such, the distal locking portion forms a series of resilient locking segments which flex radially outward to receive the mouth and then flex radially inward to lock the mouth in place. The distal locking portion 110 may be provided with any desired number of slits 112 to allow the mouth 96 to pass through the opening 114 and to be held by the distal locking portion 110. The front wall 16 of the container is provided with an opening 8 configured to allow the mouth 96 to be inserted therethrough such that the mouth 96 remains firmly retained in the front wall 16.

Figure 9A:
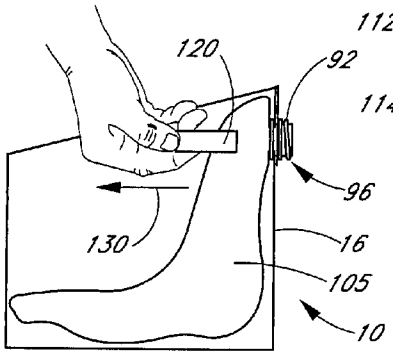
FIG. 9*a* is a cutaway view of an improved beverage container with a flexible bag having desirable features and advantages.

In order to fill the bag 105 with a fluid, the vacuum within the bag may need to be released, as discussed above. One way to accomplish this is to introduce air into the bag 105, thereby separating a front sheet to which the spout is attached from a rear sheet of the bag 105. FIG. 9*a* illustrates an embodiment of a flexible bag 105 for use in a container as described herein. In the embodiment shown, the bag 105 is provided with a tab 120 disposed on the rear sheet immediately opposite the mouth 96. The tab 120 may be pulled away from the mouth 96, thereby introducing an initial volume of air into the bag 105 to allow the bag 105 to be filled. The tab 120 may be made of a variety of materials such that it performs as desired, such as, for example, nylon, vinyl, metallic foil, or any suitable material easily attachable to the bag 105. The tab 120 may be attached to the bag by any suitable method such as heat welding, adhesives, or in any suitable manner.

As discussed above, in the absence of this tab 120, a user must grip the material of the bag directly in order to pull on the bag 105. This may be fairly difficult due to the fact that the vacuum created during manufacture typically causes the material of the bag to be drawn tightly to the mouth 96, thus providing little or no material to grip. Thus, by providing the tab 120, a user may more easily grip the material in order to pull the material of the bag 105 away from the mouth 96 to introduce air into the bag 105 to facilitate filling. In some situations, a user may accidentally place the flexible bag 105 in the box in an "upside down" orientation. The tab 120 additionally provides an indicator that the bag 105 has been placed in the box in the preferred orientation as the tab 120 will only be accessible to a user if the bag is placed in the box in the orientation shown in FIG. 9*a*.

The outer shell bottom may be assembled as discussed above with reference to FIGS. 3*a–d*. As discussed herein, the configuration of the bottom flaps 50, 52, 54, 56 allow the outer shell 3 to be erected quickly while reducing the opportunity for error. The illustrated embodiment not only saves time by minimizing process steps required to assemble the outer shell 3, but also results in less waste from outer shells 3 erected improperly. complicated assemblies When taking into account the sales volumes some coffee shops experience, it can be appreciated that even a small savings in time and materials can result in a significant financial impact on the coffee shop.

Figure 9B:
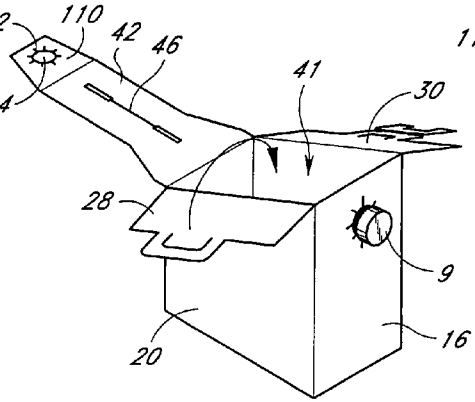
FIGS. 9*b–f* are perspective views illustrating the assembly of a top of an improved beverage container.
Figure 9C:
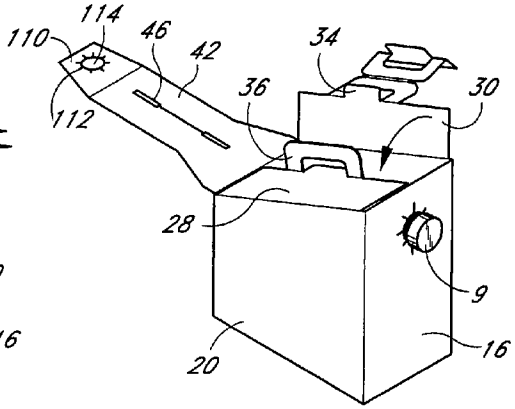
Figure 9D:
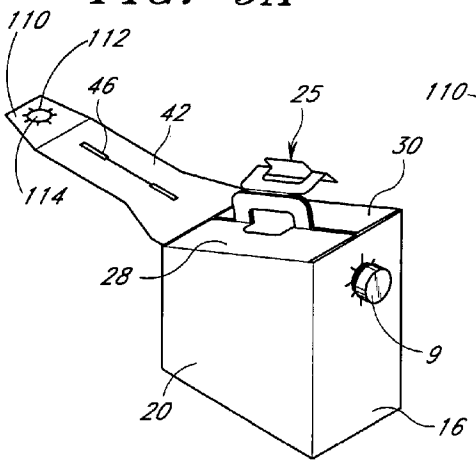
Figure 9E:
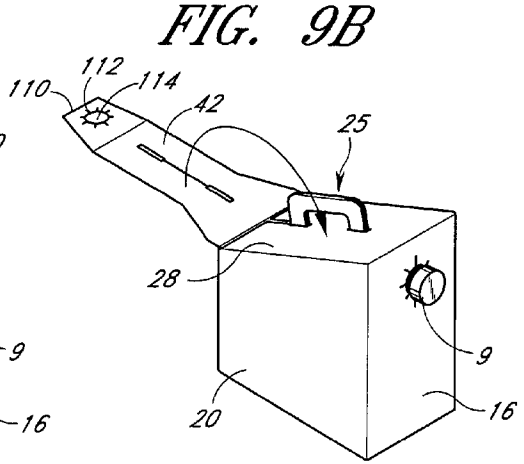
Figure 9F:
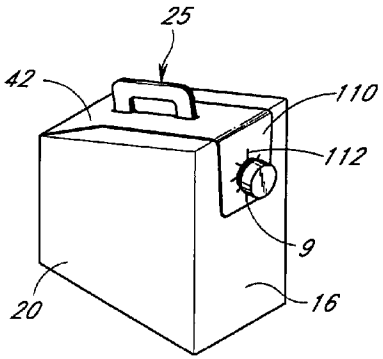

As shown in FIG. 9*a*, with the spout 9 either removed or open to allow air to flow therethrough, the tab 120 is first pulled away from the mouth 96 in the direction of the arrow 130, thereby drawing air into the bag 5. Once the tab 120 has been pulled, the handle 25 is assembled by first folding the top right handle flap 28 in towards the bag 5 (as shown in FIG. 9*b*). The top left handle flap 30 is then folded in, and the handle 25 assembled by folding the handle portions together as previously described. The top back flap 42 is then folded forward (as shown in FIG. 9*e*) such that the slot 46 surrounds the handle 25. Finally, the distal locking portion 110 is pressed over the mouth 96 until the material surrounding the opening 114 is completely held by the annular groove formed on the body of the mouth 96. Some containers in the prior art teach the use of a top front flap that forms part of the top surface, which requires the additional step of folding this flap rearward. By omitting this flap in the illustrated embodiment, the manufacturing materials and weight are reduced. While this advantage may not seem significant, when the anticipated manufacturing volumes are taken into account, even a minute cost savings in material can affect the manufacturing economics dramatically. Moreover, considering that the containers are typically shipped in a flattened state and stacked upon a pallet in great quantities, a small decrease in container weight can result in a substantial reduction in shipping costs. Additionally, by reducing the assembly time and complexity, coffee shop employees can increase efficiency because they can vend coffee filled containers faster. A reduction in assembly complexity also reduces waste resulting from containers that must be discarded due to improper assembly.

By providing a distal locking portion 110 with a complete circular opening 114 the mouth will be supported such that it remains perpendicular or tipped slightly upwards in relation to the front wall panel 16, thereby reducing or eliminating the potential for spillage. The circular opening 14 also provides additional support in preventing the mouth 96 from being pulled through the front wall 16 by the weight of the liquid in the flexible bag 105. This provides a bag 105 tightly secured within the outer shell 3 which is a significant advancement over the prior art devices. Typically, the devices in the prior art do not have this locking feature, that once assembled, is very difficult to accidentally disassemble. Moreover, the locking feature ensures that the mouth is adequately supported and that the top of the box will remain assembled. Moreover, this configuration provides an easy to assemble outer shell having fewer steps than the containers in the prior art. Given the sales volumes many coffee shops experience, by reducing even a single assembly step or minimizing assembly time, the coffee shop enjoys a significant productivity increase.

Figure 10:
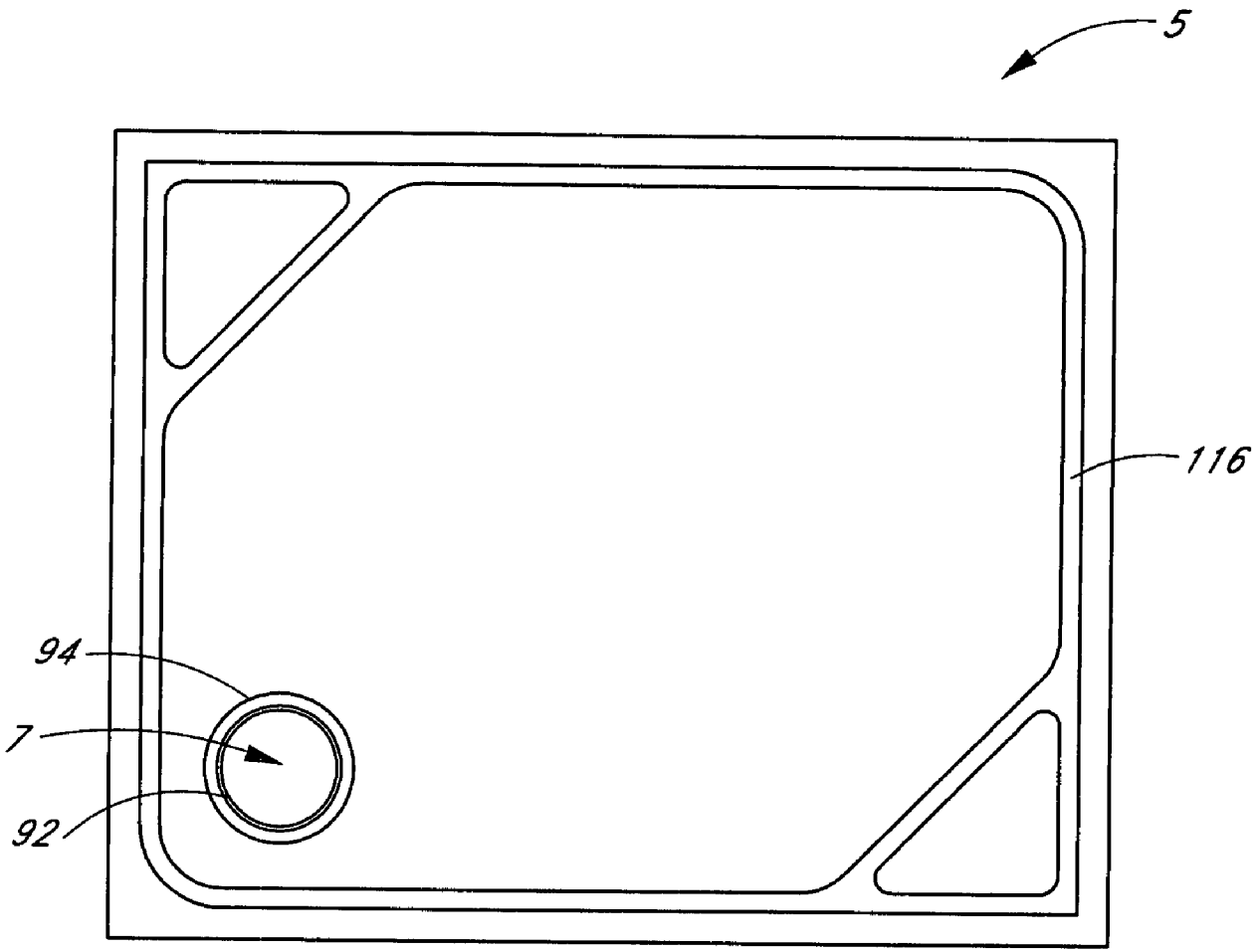
FIG. 10 is a plan view of an alternative embodiment of a flexible bag and mouth of the improved beverage container of FIGS. 8–9.

An additional embodiment of a bag 5 is illustrated in FIG. 10. The bag 5 is preferably made by overlapping two sheets of heat sensitive material and forming a heat weld 116 around the perimeter of the bag. This seals the two sheets of material together to form a fluid-tight reservoir. Additionally, the heat weld 116 may be used to size and shape the bag as desired. If desired, the bag 5 may be cut to size around the periphery of the heat weld 116. The bag is also configured with a cylindrical body 92 defining a mouth 7. The mouth is preferably sized to receive a liquid flow such as from a dispensing spigot as described above. The mouth may be attached to the bag during the heat welding step, as is known in the art, or may be fastened subsequently. According to one embodiment, one sheet of heat sensitive material is preconfigured with an appropriately sized hole to receive the cylindrical body 92 while inhibiting passage of the outer rim 94. Thus, the cylindrical body 92 may be inserted through the hole from the inside surface of the top sheet of bag material, which is then superimposed upon a lower sheet of bag material. A heat welder then contacts the bag material and applies heat and pressure to fuse the two sheets of material together in a desired configuration, as is well known in the art. The heat welder additionally applies heat and pressure circumferentially to the cylindrical body 92 thus fusing the top sheet of bag material to the outer rim 94. Thus, a fluid-tight bag having a mouth 7 to allow communication with the interior of the bag is easily produced. As described above, the cylindrical body 92 may be provided with external threads that cooperate to receive a spout or cap thereon to either facilitate dispensing or sealing of the contents within the bag. The illustrated bag 5 is only representative of one possible bag configuration. Other configurations, including the bag size and shape, will be apparent to those of skill in the art.

The result of the disclosure herein provides a container that, among other things, is quick and easy to assemble, minimizes storage space due to its initial collapsed state, reduces manufacturing and shipping costs due to a decrease an material required to manufacture, provides a sturdy container that inhibits unintended disassembly, securely locks a mouth of a bag in its intended position, and is disposable after use.

Those of skill in the art will recognize that there are numerous variations and modifications of the improved beverage container which are encompassed by the scope of the present invention. Accordingly, the foregoing description should be considered illustrative of the invention and not deemed to limit its scope.

What is claimed is:

1. A beverage container, comprising:

an outer shell comprising first, second, third, and fourth sidewalls; wherein said first sidewall has a first opening formed therein and defines a free upper edge, said first sidewall having a lower flap depending therefrom, said second sidewall has an upper flap extending therefrom defining a first handle portion, and a lower flap;

said third sidewall has an upper flap extending therefrom comprising a slot for receiving a handle and a second opening formed therein, and said third sidewall further comprising a lower flap depending therefrom;

said fourth sidewall has an upper flap extending therefrom defining a second handle portion, and a lower flap;

wherein said upper flaps cooperate to form a top surface of said outer shell and said lower flaps cooperate to form a bottom surface of said outer shell; and wherein said first opening and said second opening cooperate to receive and support a mouth of a flexible inner liner configured to receive and store a liquid beverage.

2. The beverage container as in claim 1, wherein said lower flaps cooperate to provide a plurality of layers defining said bottom surface of said outer shell.

3. The beverage container as in claim 1, wherein said upper flaps cooperate to define said handle.

4. The beverage container as in claim 1, wherein said flexible inner liner has a bag portion and a mouth portion.

5. The beverage container as in claim 4, wherein said mouth portion is disposed through said first opening and said second opening and is supported thereby.

6. The beverage container as in claim 5, wherein said mouth portion defines a retaining portion configured to receive a peripheral edge of each of said first and second openings thereby maintaining the mounted relationship therewith.

7. The beverage container as in claim 1, wherein said first handle portion cooperates with said second handle portion to define said handle.

8. The beverage container as in claim 7, wherein said handle extends in a plane substantially orthogonal to a plane of said upper surface.

9. The beverage container as in claim 8, wherein said plane of said upper surface forms an acute angle with respect to a plane of said bottom surface.

10. The beverage container as in claim 9, wherein rotating said container such that said handle is substantially horizontal causes liquid in said container to dispense through said mouth.

11. The beverage container as in claim 1, wherein said flexible inner liner is affixed to the outer shell at one or more locations.

12. The beverage container as in claim 11, wherein said flexible inner liner is adhered to one or more of said first sidewall, second sidewall, third sidewall, and fourth sidewall.

* * * * *

UNITED STATES PATENT AND TRADEMARK OFFICE

CERTIFICATE OF CORRECTION

PATENT NO. : 7,077,309 B2
APPLICATION NO. : 10/626176
DATED : July 18, 2006
INVENTOR(S) : Jared P. Andrews It is certified that error appears in the above-identified patent and that said Letters Patent is hereby corrected as shown below:

Page 1, Col. 1, below "US 2005/0017011 A1 Jan. 27, 2005" insert --Related U.S. Application Data--, followed by --(60) Provisional Application No. 60/453,731, filed on Jul. 24, 2002.--

Signed and Sealed this

Sixth Day of May, 2008

JON W. DUDAS
*Director of the United States Patent and Trademark Office*